US007955236B2

(12) United States Patent
DiGiovanni et al.

(10) Patent No.: US 7,955,236 B2
(45) Date of Patent: Jun. 7, 2011

(54) FOOT AND ANKLE EXERCISE DEVICE

(75) Inventors: Craig S. DiGiovanni, Southlake, TX (US); Blair R. Patton, Choteau, MT (US)

(73) Assignee: Medi-Dyne Healthcare Products, Ltd., Colleyville, TX (US)

( * ) Notice: Subject to any disclaimer, the term of this patent is extended or adjusted under 35 U.S.C. 154(b) by 0 days.

(21) Appl. No.: 12/485,723

(22) Filed: Jun. 16, 2009

(65) Prior Publication Data

US 2010/0317495 A1 Dec. 16, 2010

(51) Int. Cl.
*A63B 21/02* (2006.01)
*A63B 21/04* (2006.01)

(52) U.S. Cl. ..... 482/124; 482/129

(58) Field of Classification Search ..... 482/121, 482/124–126, 79, 148; 602/28
See application file for complete search history.

(56) References Cited

U.S. PATENT DOCUMENTS

| | | | | | |
|---|---|---|---|---|---|
| 866,495 | A * | 9/1907 | Marks | 482/124 |
| 1,706,654 | A * | 3/1929 | Christesen | 482/125 |
| 4,456,249 | A * | 6/1984 | Calabrese | 482/124 |
| 5,100,129 | A * | 3/1992 | Porter et al. | 482/129 |
| 5,186,698 | A | 2/1993 | Mason et al. | 482/79 |
| RE34,351 | E * | 8/1993 | Lacey | 119/776 |
| 5,518,486 | A * | 5/1996 | Sheeler | 482/131 |
| 5,558,609 | A * | 9/1996 | Olschansky et al. | 482/122 |
| 5,688,213 | A * | 11/1997 | Recker | 482/125 |
| 5,807,218 | A * | 9/1998 | Nagatomo | 482/124 |
| 5,951,443 | A * | 9/1999 | Askins | 482/74 |
| 5,984,845 | A | 11/1999 | Powers | 482/148 |
| 6,368,258 | B1 * | 4/2002 | Emlaw | 482/124 |
| 6,540,651 | B1 * | 4/2003 | Aberton et al. | 482/124 |
| 6,840,894 | B2 * | 1/2005 | Lerner | 482/124 |
| 7,087,003 | B1 * | 8/2006 | Katterjohn | 482/124 |
| 7,699,761 | B1 * | 4/2010 | Dieter et al. | 482/124 |
| 2003/0130098 | A1 * | 7/2003 | Marco | 482/124 |
| 2005/0282689 | A1 * | 12/2005 | Weinstein | 482/124 |
| 2006/0183609 | A1 * | 8/2006 | Flynn | 482/124 |
| 2008/0009398 | A1 * | 1/2008 | Grisdale | 482/124 |
| 2009/0149303 | A1 * | 6/2009 | Meisterling | 482/124 |

* cited by examiner

*Primary Examiner* — Fenn C Mathew
(74) *Attorney, Agent, or Firm* — Baker Botts L.L.P.

(57) ABSTRACT

The present invention relates to a foot and ankle exercise device. The exercise device may include a foot strap, a pull strap, a handle, and a resistance band. The foot strap may be adjustable to secure the device to a user's foot. The pull strap may have a first end attached to the foot strap. The handle may be disposed on a second end of the pull strap and may be configured to allow the user to apply tension to the pull strap. The resistance band may be disposed on the pull strap between the first end and the second end of the pull strap.

10 Claims, 5 Drawing Sheets

FOOT AND ANKLE EXERCISE DEVICE

FIELD OF THE INVENTION

The present invention relates to an exercise device. The device may be used to stretch or strengthen muscles and tissues around the foot and/or ankle during exercise or physical therapy.

BACKGROUND

Ankle injuries are one of the most common injuries suffered world-wide. Sprains, strains, and/or fractures can occur during active exercise, sports competition, and even when walking in an office or along the street. Some individuals recover from ankle injuries without active treatment. On the other hand, ankle injuries often result in residual effects (e.g., local weakness and/or loss of balance). Residual effects may be reduced and/or eliminated by well-designed and executed rehabilitation exercises and/or treatment.

A course of rehabilitation may address various goals. For example, goals may include total body balance, range of motion, strength, coordination, and/or stabilization. A variety of exercises may address one or more of these goals. An exercise device that provides a variety of ankle strengthening exercises may address multiple goals. Achieving these goals may help to prevent recurrent injury, to speed recovery, and/or reduce pain.

SUMMARY OF THE INVENTION

Teachings of the present disclosure relate to a foot and ankle exercise device. In some embodiments of the teachings of the present disclosure, the exercise device may include a foot strap, a pull strap, a handle, and a resistance band. The foot strap may be adjustable to secure the device to a user's foot. The pull strap may have a first end attached to the foot strap. The handle may be disposed on a second end of the pull strap and may be configured to allow the user to apply tension to the pull strap. The resistance band may be disposed on the pull strap between the first end and the second end of the pull strap.

Another embodiment of the teachings of the present disclosure may comprise an exercise device. The device may include a pull strap, a handle, an elastic resistance band, and a foot strap. The pull strap may have a first end and a second end. The handle may be disposed on the first end of the pull strap and may be configured to allow a user to apply tension to the pull strap. The elastic resistance band may be disposed on the pull strap between the first end and the second end. The foot strap may be configured to secure the device to a user's foot. The foot strap may be connected to the second end of the pull strap by a connector configured to provide full freedom of rotation between the pull strap and the foot strap.

Another embodiment of the teachings of the present disclosure may include a method of using an exercise device. The method may include engaging a foot strap to secure the device to a user's foot, applying tension to a handle disposed on the pull strap, and moving the user's foot against the tension applied to the pull strap. The pull strap may have a first end attached to the foot strap and a second end including the handle. Moving the user's foot may include stretching a resistance band disposed on the pull strap between the first end and the second end of the pull strap.

Exercise devices designed or used based on the teachings of the present disclosure may be made of a variety of materials, including nylon, polypropylene, plastic, and/or latex.

The best way to treat an ankle injury may be to prevent it from happening in the first place. One way to prevent ankle injuries includes building strength, flexibility, and balance using the teachings of the present disclosure.

Exercise devices incorporating the teachings of the present disclosure may provide versatility and/or increased safety in comparison to alternative devices. For example, the connection between the pull strap and the foot strap may provide full freedom of rotation between the pull strap and the foot strap. Such a connection may allow a user to vary the exercises performed without changing and/or reorienting the device.

As another example, exercise devices incorporating teachings of the present disclosure may include one or more features allowing the user to adjust the maximum extension length for the resistance band. For example, the resistance band may be connected in parallel a portion of the pull strap. In such examples, when the resistance band is stretched to the same length as the portion of the pull strap connected in parallel, the resistance band will not stretch any further.

As another example, exercise devices incorporating teachings of the present disclosure may include one or more features allowing the user to adjust the total length of the pull strap, providing adjustable length for various users and/or for a single user in various orientations.

BRIEF DESCRIPTION OF THE DRAWINGS

A more complete and thorough understanding of the present invention and advantages thereof may be acquired by referring to the following description taken in conjunction with the accompanying drawings, in which like reference numbers indicate like features, and wherein.

DETAILED DESCRIPTION

Specific embodiments of the invention and its advantages are best understood by reference to FIGS. 1-7 wherein like numbers refer to same and like parts.

Figure 1:
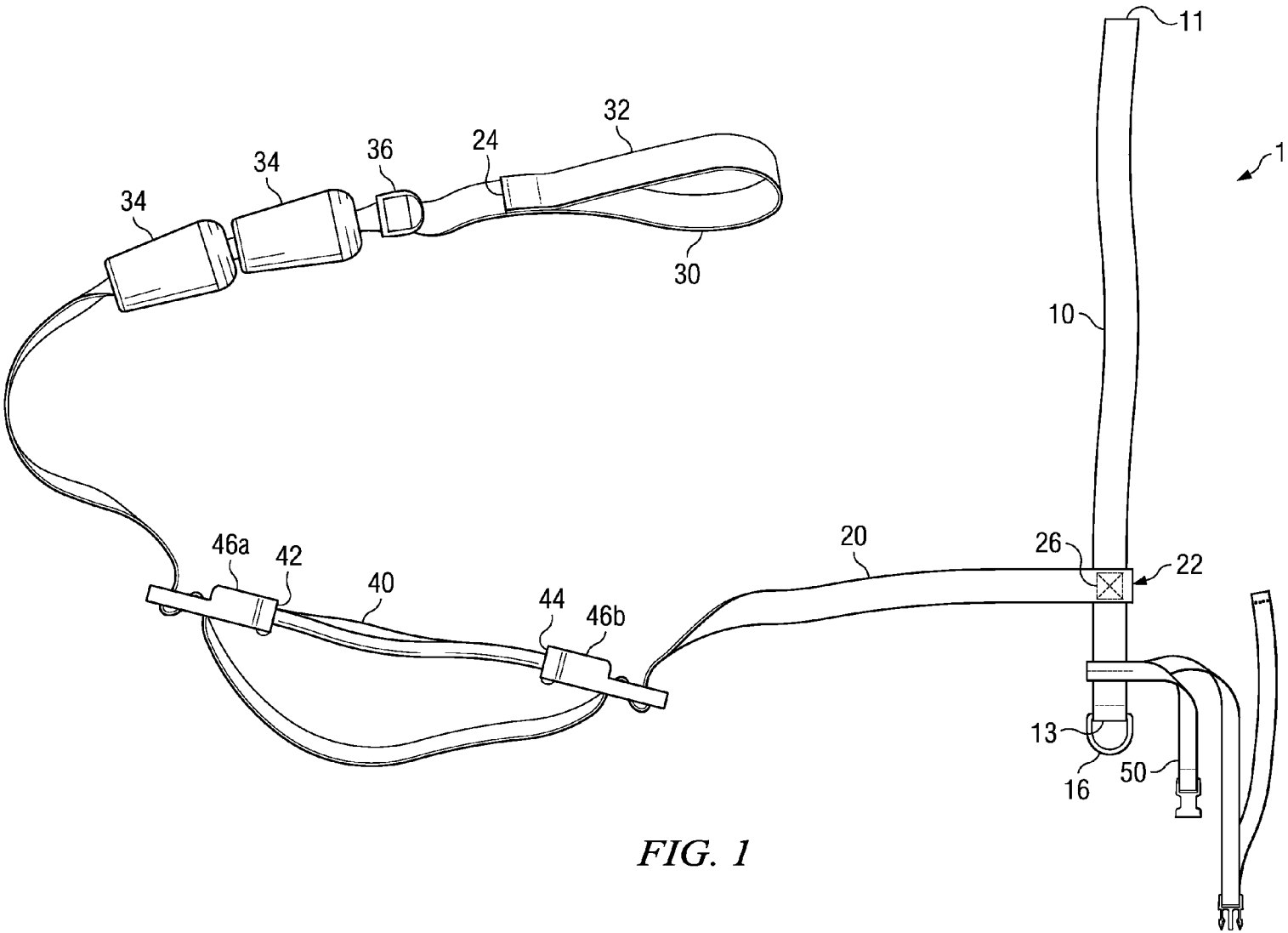
FIG. 1 illustrates an exercise device for strengthening the foot and ankle, according to an embodiment of the present disclosure.

FIG. 1 illustrates an exercise device 1 for strengthening the foot and ankle, according to an embodiment of the present disclosure. Exercise device 1 may include a foot strap 10, a pull strap 20, a handle 30, a resistance band 40, and an ankle strap 50. Exercise device 1, when used in accordance with the teachings of the present disclosure, may provide strengthening and balance-building exercises for the muscles around the ankle.

Figure 3A:
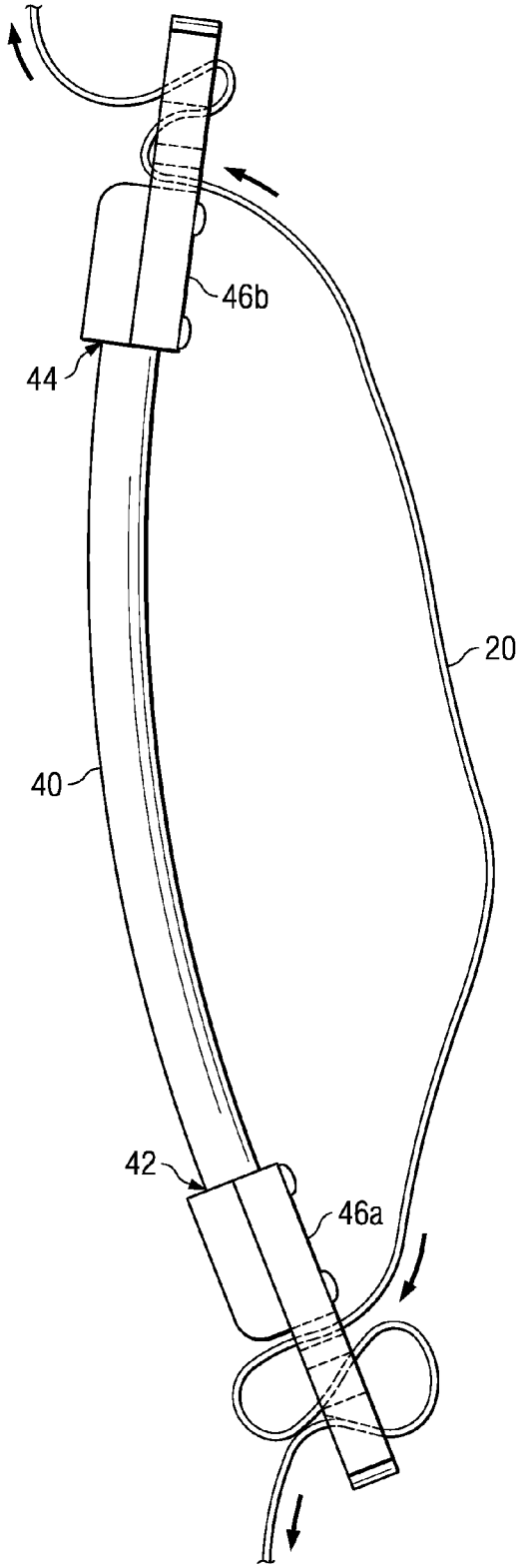
FIGS. 3A and 3B illustrate portions of the exercise device of FIG. 1.
Figure 3B:
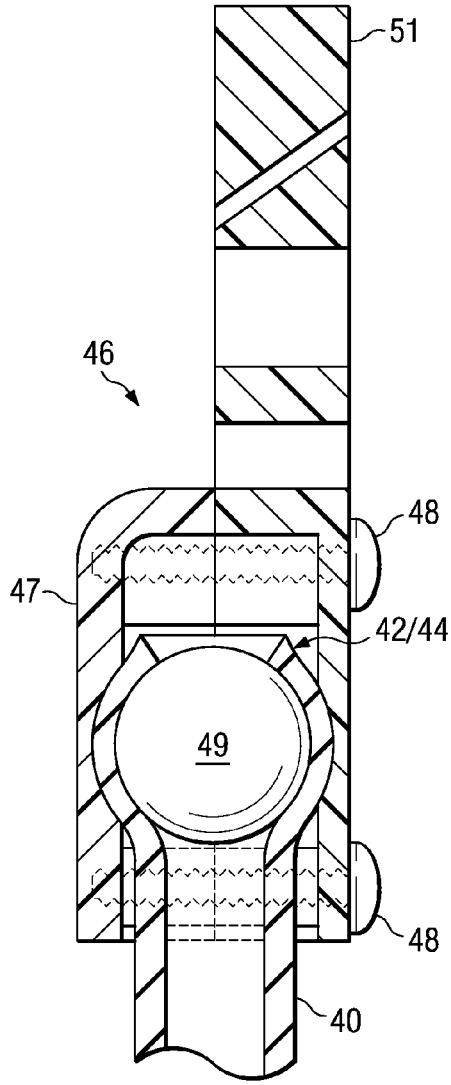

Foot strap 10 may include any feature, component, and/or device configured to secure exercise device 1 to a user's foot 60 (foot 60 shown in FIGS. 3A-3C). Foot strap 10 may be configured to provide an adjustable and/or releasable connection between exercise device 1 and user's foot 60. Foot strap 10 may include a first end 11 and a second end 13. In some embodiments, foot strap 10 may include a ring 16. Foot strap 10 may be made of any appropriate material (e.g., nylon and/or another plastic). Foot strap 10 may include any fasteners, connectors, and/or devices for securing exercise device 1 to user's foot 60.

Figure 2A:
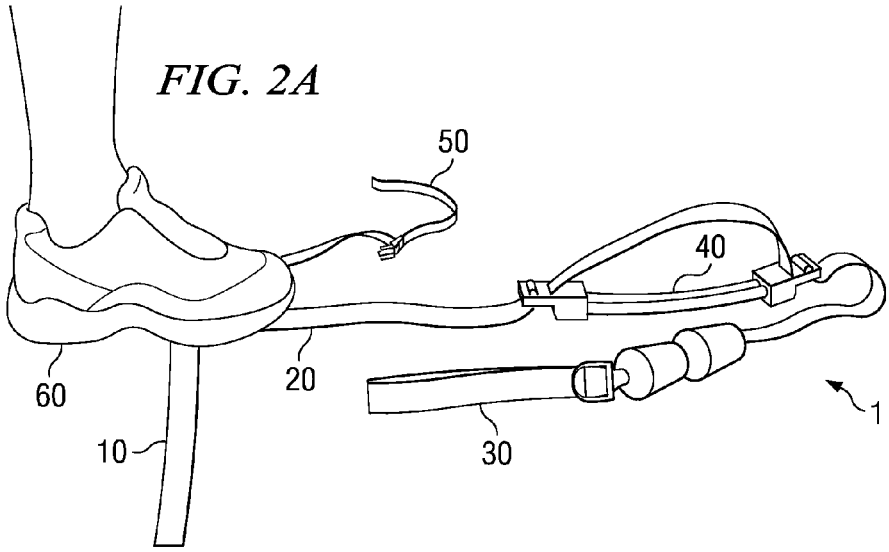
FIGS. 2A-2C illustrate a method of preparing an exercise device for use according to an embodiment of the present disclosure.
Figure 2B:
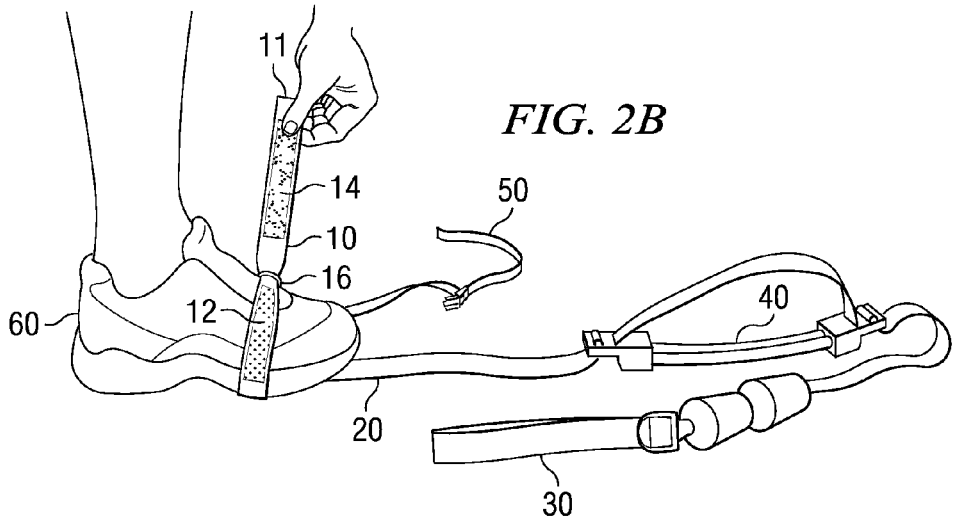
Figure 2C:
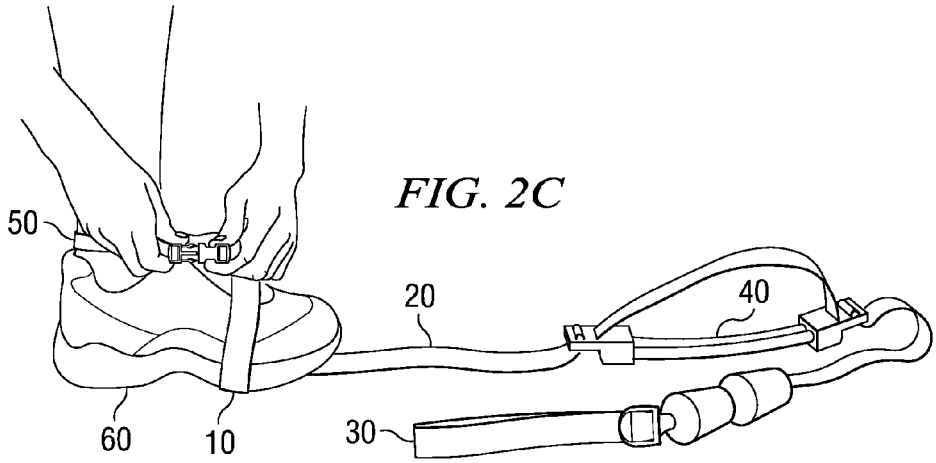

Ring 16 may include a device, feature, and/or component configured to facilitate the connection of foot strap 10 to a user's foot. As shown in FIG. 1, ring 16 may include a d-ring. One example method for connecting foot strap 10 to user's foot 60 using ring 16 is shown in FIGS. 2A-2C.

Pull strap 20 may include any feature, device, and/or component of exercise device 1 configured to allow a user to apply force to foot strap 10. For example, pull strap 20 may be connected to foot strap 10 so that pulling handle 30 applies tension to pull strap 20 and force to foot strap 10. Pull strap 20 may be formed of any appropriate material (e.g., nylon webbing, etc.). Pull strap 20 may include a first end 22 and a second end 24.

The attachment 26 between foot strap 10 and pull strap 20 may be any device, component, and/or feature of foot strap 10 and/or pull strap 20 configured to provide a secured connection between foot strap 10 and pull strap 20. In addition, in some embodiments, attachment 26 may provide for complete freedom of rotation between foot strap 10 and pull strap 20. In contrast to solutions including one or more discrete connection points, freedom of rotation allows a user of exercise device 1 to perform multiple exercises without adjusting the position of foot strap 10, exercise device 1, and/or attachment 26. As examples, attachment 26 may include a firmly stitched connection, and/or a rotating clip or fastener.

Handle 30 may include any feature, device, and/or component of exercise device 1 configured to accommodate the hands of a user pulling pull strap 20. For example, handle 30 may include a loop 32 formed by looping the material of pull strap 20. In other embodiments, handle 30 may include additional devices or components (e.g., comfort handles 34 and buckle 36).

Comfort handles 34 may include any device and/or component configured to facilitate the grip of a user. For example, as shown in FIG. 1, comfort handles 34 may include conically shaped segments. Handgrips with a conical shape may be easier to grasp than straight-sided grips. In addition, the distance between first end 22 of pull strap 20 and comfort handles 34 may be adjustable (e.g., with buckle 36).

Resistance band 40 may include any device, component, and/or feature of exercise device 1 configured to provide resistance when stretched. Persons having ordinary skill in the art will recognize that the rate of stretch (elastic modulus) of resistance band 40 may be chosen from a wide range of resistances depending on the intended user, desired exercise, and/or additional considerations. Resistance band 40 may include a first end 42 and a second end 44. In addition, resistance band 40 may include connectors 46*a* and 46*b* (discussed in more detail in relation to FIG. 3).

Resistance band 40 may be connected in parallel to pull strap 20. FIG. 1 shows resistance band 40 in a relaxed or unstretched state. As shown therein, the relaxed length of resistance band 40 is shorter than the length of pull strap 20 between connectors 46*a* and 46*b*. Such a configuration allows pull strap 20 to act as a safety limit for resistance band 40. If resistance band 40 is stretched to the same length as the length of pull strap 20 between connectors 46*a* and 46*b*, pull strap 20 will bear any additional tension without further elongation of resistance band 40. Embodiments of exercise device 1 including this feature may reduce and/or eliminate the danger of damage to resistance band 40 by overstretching.

Some embodiments of exercise device 1 may include ankle strap 50. As shown in FIG. 1, ankle strap 50 may include a strap configured to fit around the ankle of the user. Ankle strap 50 may include one or more features and/or components configured to provide adjustments in the length of ankle strap 50. Embodiments of exercise device 1 including ankle strap 50 may provide increased safety or increased security. For example, ankle strap 50 may provide a second connection to user's foot 60 and/or may reduce the chance that foot strap 10 may move in relation to user's foot 60.

FIGS. 2A-2C illustrate a method of preparing exercise device 1 for use according to an embodiment of the present disclosure. In the method shown in FIGS. 2A-2C, a user may adjust foot strap 10 to secure exercise device 1 to the user's foot 60. The user may choose either the right foot or the left foot for exercise.

As shown in FIG. 2A, the user may place user's foot 60 on exercise device 1 so that foot strap 10 extends to the right and to the left of the user. At the same time, pull strap 20 of exercise device 1 may extend from the toes of user's foot 60. In some embodiments, foot strap 10 may be centered between the ball and the arch of user's foot 60. In some embodiments, pull strap 20 may be centered below user's foot 60.

FIG. 2B illustrates a method useful for at least one embodiment of foot strap 10 according to the teachings of the present disclosure. As noted above, foot strap 10 may include any fasteners, connectors, and/or devices for securing exercise device 1 to user's foot 60. In the embodiment shown in FIG. 2B, foot strap 10 may include a hook and loop fastener. A hook section 12 may be disposed on foot strap 10 to connect to a loop section 14. As shown in FIG. 2B, a user may tighten foot strap 10 around user's foot by pulling first end 11 of foot strap 10 through ring 16 (located on second end 13). The user can then engage hook section 12 to loop section 14, securing foot strap 10 to user's foot 60.

FIG. 2C illustrates a method for attaching ankle strap 50 to the user's ankle. As described in relation to FIG. 1, ankle strap 50 may provide additional security and/or safety compared to foot strap 10 alone.

FIG. 3A illustrates a portion of exercise device 1, including an enlarged and detailed view of the relation between resistance band 40 and pull strap 20. In the example shown in FIG. 3, connector 46*a* is disposed at first end 42 of resistance band 40 and connector 46*b* is disposed at second end 44 of resistance band 40. Connectors 46 may provide an adjustable and/or releasable connection between resistance band 40 and pull strap 20.

In the example embodiment, pull strap 20 may be threaded between various slots in connectors 46. The length of pull strap 20 between connector 46*a* and 46*b* may be generally equivalent to the maximum length of resistance band 40 when stretched. If the length of pull strap 20 between connectors 46 is adjustable, the maximum stretched length of resistance band 40 is likewise adjustable. This may provide for adjustable tension and/or resistance in exercise device 1 without changing resistance band 40.

A user may vary the resistance offered by exercise device 1 by increasing the force with which handle 30 is pulled during an exercise. The embodiment shown in FIG. 3A illustrates a safety feature which allows proper stretching without overstretching.

FIG. 3B illustrates an example embodiment of connector 46 which may be used to practice the teachings of the present disclosure. The embodiment of connector 46 shown in FIG. 3B may be used with a resistance band 40 that is tubular, as shown.

Connector 46 may include a first part 47 and a second part 51, a ball 49, and screws 48. Connector 46 may be disposed at either end of resistance band 40 (e.g., first end 42 or second end 44). First part 47 and second part 51 of connector 46 may be configured to clamp over the end of resistance band 40. As shown in FIG. 3B, first part 47 and second part 51 may also clamp over ball 49 disposed inside a tubular resistance band 40. First part 47 and second part 51 may be fastened by any appropriate means of connection. FIG. 3B illustrates the use of screws 48, but persons having ordinary skill in the art will be able to substitute a variety of other connectors.

Connectors 46 that include the feature of clamping over a ball 49 disposed in a tubular resistance band 40 may provide several benefits over alternative connection methods. For example, the assembly process for connector 46 and exercise device 1 may require fewer steps, and/or fewer parts. As another example, the strength of the connection between connector 46 and resistance band 40 may be greater than that provided by alternative connections.

Although FIG. 3B shows slots for pull strap 20 disposed within second part 51, the connection between pull strap 20 and connector 46 may use any feature of connector 46 and/or be disposed in any appropriate location. For example, the features or devices may be located on either part (e.g., 47 or 51), may include components of each part, and/or may interface with resistance band 40.

FIGS. 4-7 illustrate multiple uses of exercise device 1, according to an embodiment of the present disclosure. One common ankle injury is an inverted ankle sprain, in which the outside of the ankle is stretched excessively. Performing exercises that strengthen the inside and outside muscles of the ankle may prevent inverted ankle sprains.

Figure 4:
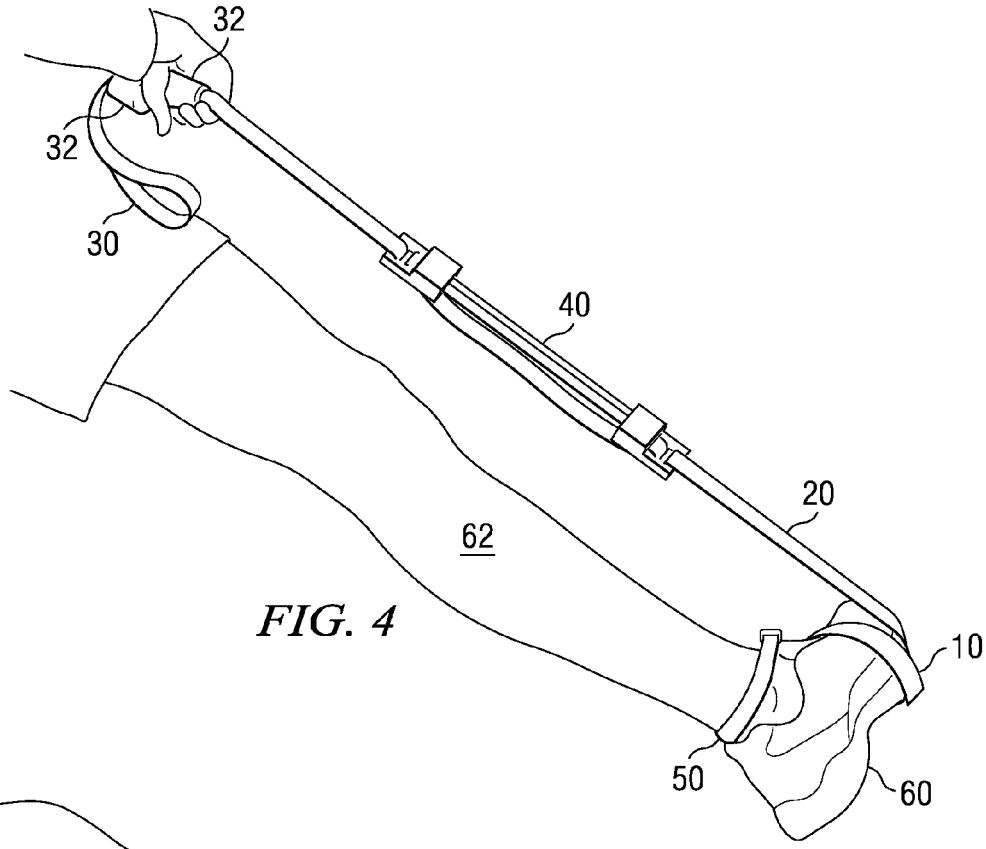
FIGS. 4-7 illustrate multiple uses of the exercise device illustrated in FIG. 1, according to an embodiment of the present disclosure.

For example, FIG. 4 illustrates a method for performing a resisted inversion exercise. As shown, a user may wrap pull strap 20 under user's foot 60 to the outside. User may hold onto comfort handles 32 and pull gently along user's leg 62. From that position, turning user's foot 60 inward using a slow, smooth, full range of motion may provide strengthening. One example exercise program may include a total of 2-3 sets of 15-20 repetitions of a resisted inversion exercise.

Figure 5:
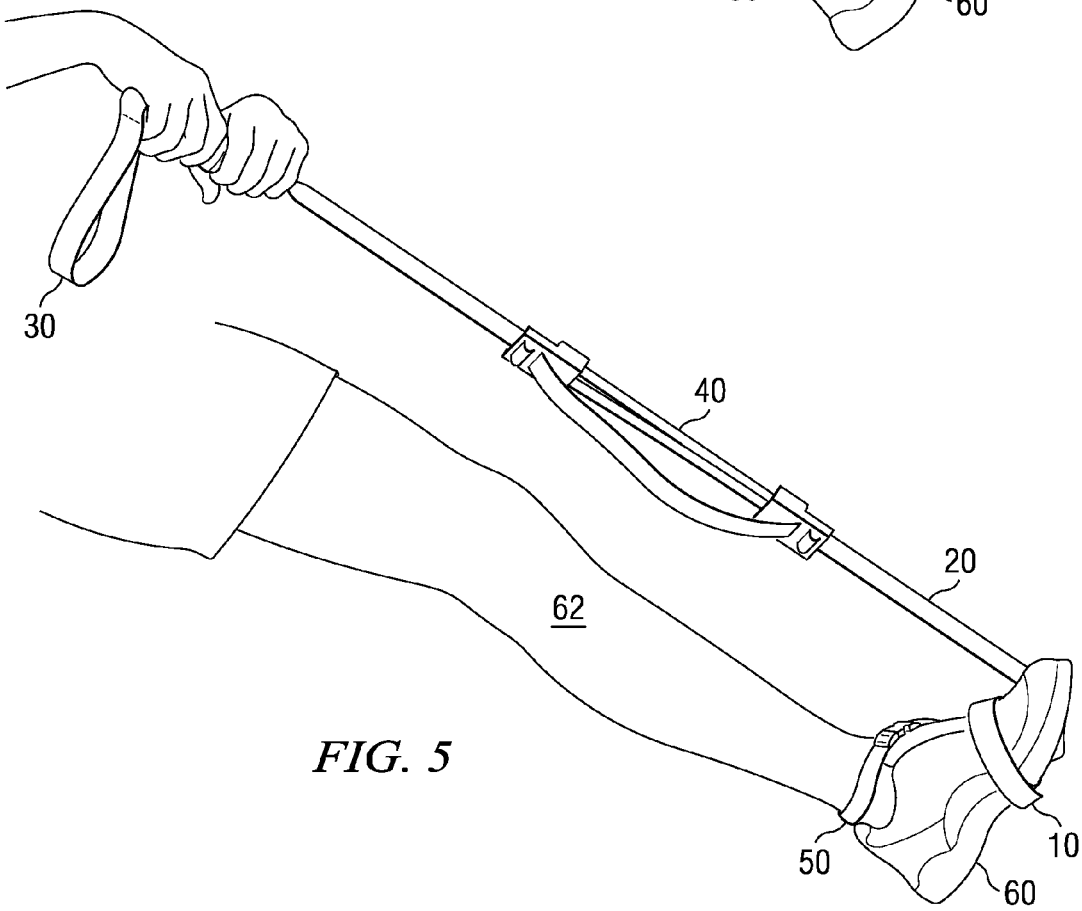

As another example, FIG. 5 illustrates a method for performing a resisted eversion exercise. As shown, a user may wrap pull strap 20 under user's foot 60 to the inside. User may hold onto comfort handles 32 and pull gently along user's leg 62. From that position, turning user's foot 60 outward using a slow, smooth, full range of motion may provide strengthening. One example exercise program may include a total of 2-3 sets of 15-20 repetitions of a resisted eversion exercise.

Figure 6:
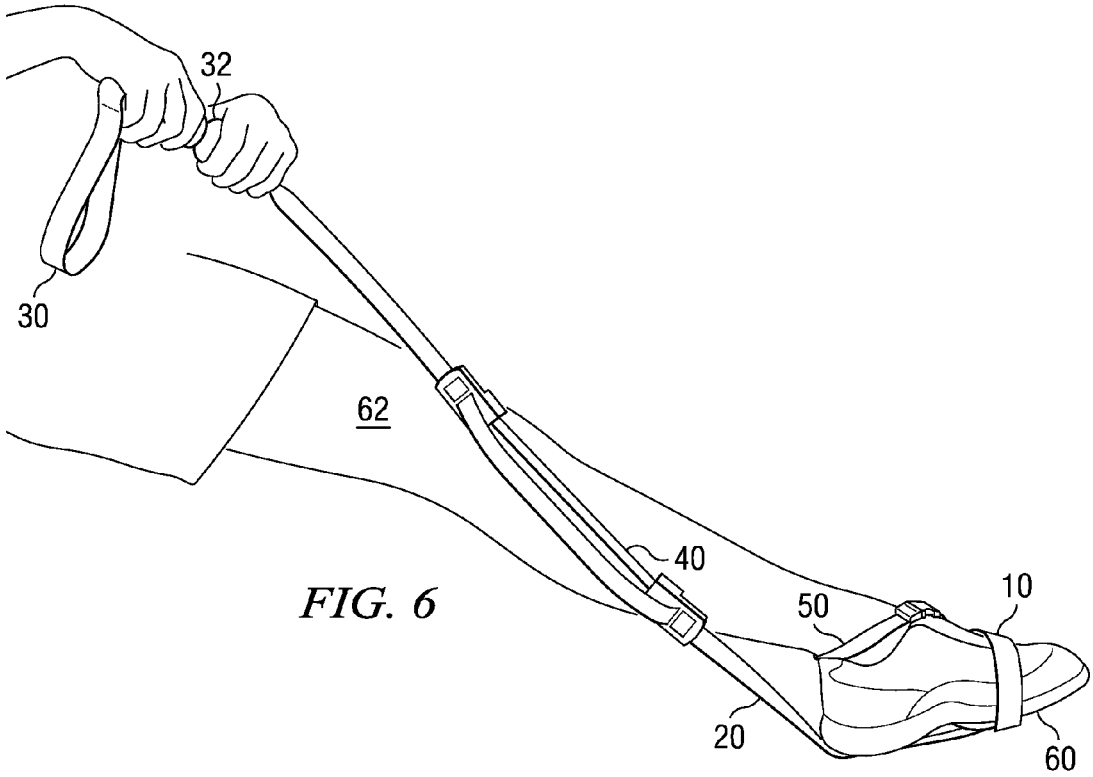

A resisted dorsiflexion exercise may strengthen the anterior (front) muscles of the ankle, calf, and/or lower leg. Resisted dorsiflexion exercise may help to prevent shin splints, ankle sprains, and/or stress fractures. FIG. 6 illustrates a method for performing a resisted dorsiflexion exercise. As shown, a user may wrap pull strap 20 under the heel of user's foot 60 to the rear. User may hold onto comfort handles 32 and pull gently along user's leg 62. From that position, extending the heel of user's foot 60 outward using a slow, smooth, full range of motion may provide strengthening. One example exercise program may include a total of 2-3 sets of 15-20 repetitions of a resisted dorsiflexion exercise.

Figure 7:
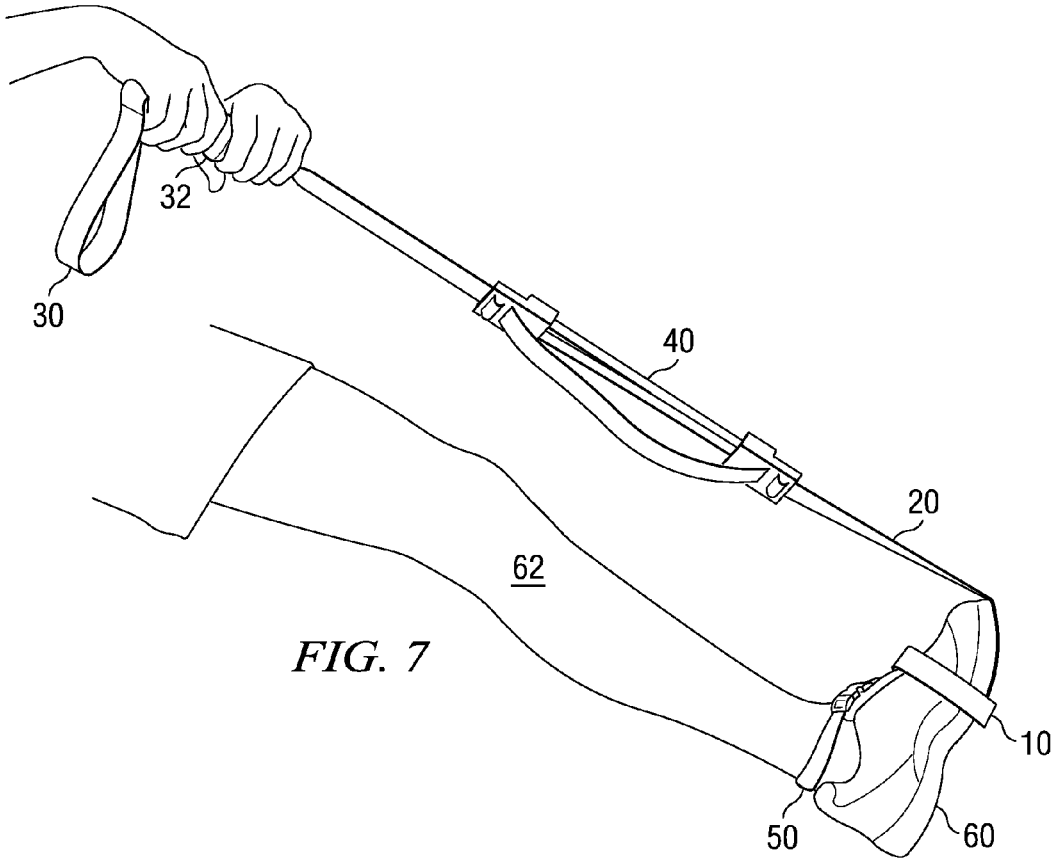

A resisted plantar flexion exercise may strengthen the posterior (rear) muscles of the ankle, the shin, the Achilles tendon, and/or the plantar fascia. Resisted planter flexion exercise may help to prevent shin splints, ankle sprains, Achilles injuries, and/or plantar fasciitis. FIG. 7 illustrates a method for performing a resisted planter flexion exercise. As shown, a user may wrap pull strap 20 under the toes of user's foot 60 to the front. User may hold onto comfort handles 32 and pull gently along user's leg 62. From that position, pointing the toes of user's foot 60 using a slow, smooth, full range of motion may provide strengthening. One example exercise program may include a total of 2-3 sets of 15-20 repetitions of a resisted plantar flexion exercise.

Use of exercise devices embodying the teachings of the present disclosure may provide versatility, safety, comfort, and/or other advantages in comparison with prior solutions. For example, the exercise devices described can be adjusted to tailor an exercise program for an individual user based on medical history, injury, strength, stature, and/or other considerations.

Although the present invention and its advantages have been described in detail, it should be understood that various changes, substitutions and alternations can be made herein without departing from the spirit and scope of the invention as defined by the following claims.

The invention claimed is:

1. An exercise device comprising:

a foot strap adjustable to secure the device to a user's foot;

a pull strap having a first end attached to the foot strap and a second end;

a handle disposed on a second end of the pull strap, the handle configured to allow the user to apply tension to the pull strap; and a resistance band disposed on the pull strap between the first end and the second end of the pull strap;

the resistance band having two ends;

the resistance band attached in parallel to the pull strap; and a connector between the pull strap and the resistance band located at each of the two ends of the resistance band, the connectors providing a maximum extension length for the resistance band;

wherein the maximum extension length for the resistance band is generally equivalent to the length of the pull strap disposed between the two ends of the resistance band;

wherein the resistance band includes a length of tube; and wherein each connector includes:

a ball disposed with the length of tube; and two sides fixed together to compress the resistance band around the ball disposed within the length of tube;

wherein the force exerted by the two sides against the resistance band and the ball resists any axial force exerted by the extension of the resistance band when the exercise device is used.

2. An exercise device according to claim 1, further comprising an ankle safety strap.

3. An exercise device according to claim 1, further comprising one or more comfort handles having a conical shape.

4. An exercise device according to claim 1, wherein the length of the pull strap disposed between the two ends of the resistance band is adjustable.

5. An exercise device according to claim 1, wherein the pull strap is substantially inelastic.

6. An exercise device comprising:

a pull strap having a first end and a second end;

a handle disposed on the first end of the pull strap, the handle configured to allow a user to apply tension to the pull strap;

an elastic resistance band disposed on the pull strap between the first end and the second end of the pull strap;

a foot strap configured to secure the device to a user's foot;

the foot strap connected to the second end of the pull strap by a connector configured to provide full freedom of rotation between the pull strap and the foot strap;

the elastic resistance band having two ends and a generally tubular shape;

the elastic resistance band attached in parallel to the pull strap; and a connection between the pull strap and the elastic resistance band located at each of the two ends of the resistance band, the connection providing a maximum extension length for the resistance band;

wherein the maximum extension length for the elastic resistance band is generally equivalent to the length of the pull strap disposed between the two ends of the elastic resistance band;

wherein each connection includes:

a ball disposed within the elastic resistance band; and two sides fixed together to compress the elastic resistance band around the ball disposed therein;

wherein the force exerted by the two sides against the elastic resistance band and the ball resists any axial force exerted by the extension of the elastic resistance band when the exercise device is used.

7. An exercise device according to claim 6, further comprising an ankle safety strap.

8. An exercise device according to claim 6, further comprising one or more comfort handles having a conical shape.

9. An exercise device according to claim 6, wherein the length of the pull strap disposed between the two ends of the resistance band is adjustable.

10. An exercise device according to claim 6, further comprising:

the foot strap directly connected to the second end of the pull strap by a connector configured to provided full freedom of rotation between the pull strap and the foot strap; and wherein the pull strap is substantially inelastic.

* * * * *